US007922460B2

(12) United States Patent
Nagao et al.

(10) Patent No.: US 7,922,460 B2
(45) Date of Patent: Apr. 12, 2011

(54) REFRIGERATING COMPRESSOR

(75) Inventors: Takahide Nagao, Kanagawa (JP); Akihiko Kubota, Kanagawa (JP)

(73) Assignee: Panasonic Corporation, Osaka (JP)

( * ) Notice: Subject to any disclaimer, the term of this patent is extended or adjusted under 35 U.S.C. 154(b) by 698 days.

(21) Appl. No.: 10/554,584

(22) PCT Filed: May 13, 2005

(86) PCT No.: PCT/JP2005/009209
§ 371 (c)(1),
(2), (4) Date: Oct. 26, 2005

(87) PCT Pub. No.: WO2006/030559
PCT Pub. Date: Mar. 23, 2006

(65) Prior Publication Data

US 2006/0275158 A1 Dec. 7, 2006

(30) Foreign Application Priority Data

Sep. 13, 2004 (JP) ..... 2004-265133

(51) Int. Cl.
*F04B 39/00* (2006.01)

(52) U.S. Cl. ..... 417/312

(58) Field of Classification Search ..... 417/312, 417/540, 542; 181/229, 262, 263, 403
See application file for complete search history.

(56) References Cited

U.S. PATENT DOCUMENTS 2,297,046 A * 9/1942 Bourne ..... 181/250
2,936,041 A * 5/1960 Sharp et al. ..... 181/206
4,231,228 A * 11/1980 Galvin et al. ..... 62/77
4,330,239 A * 5/1982 Gannaway ..... 417/312
4,370,104 A * 1/1983 Nelson et al. ..... 417/312
4,444,013 A * 4/1984 Inoue et al. ..... 60/605.1
4,800,985 A * 1/1989 Hanzawa et al. ..... 181/229
5,040,495 A * 8/1991 Harada et al. ..... 123/184.57
5,734,134 A * 3/1998 Park ..... 181/229
5,957,664 A * 9/1999 Stolz et al. ..... 417/53
6,129,522 A * 10/2000 Seo ..... 417/312
6,152,703 A * 11/2000 Yoshimura et al. ..... 417/312
6,158,983 A * 12/2000 Harpole et al. ..... 417/410.4
6,176,687 B1 * 1/2001 Kim et al. ..... 417/312
6,206,135 B1 * 3/2001 Kim et al. ..... 181/229
6,398,523 B1 * 6/2002 Hur et al. ..... 417/417
6,524,080 B1 * 2/2003 Chintamani et al. ..... 417/312
(Continued)

FOREIGN PATENT DOCUMENTS

EP 1 304 480 4/2003
(Continued)

*Primary Examiner* — Devon C Kramer
*Assistant Examiner* — Dnyanesh Kasture
(74) *Attorney, Agent, or Firm* — Wenderoth, Lind & Ponack, L.L.P.

(57) ABSTRACT

A refrigerating compressor includes a compressing element and a hermetic container accommodating the compressing element, which includes a compressing chamber where refrigerant gas is compressed, and a suction muffler (118) having a sound deadening space (119) and communicating with the compressing chamber. The suction muffler (118) includes a tail tube (121) having a first end open into the hermetic container and a second end open into the sound deadening space (119), and a resonating chamber (122) formed attached to the tail tube (121) and having a resonance frequency substantially agreeing with a specific resonance frequency of the hermetic container. This structure allows the resonating chamber (122) to deaden the noises coming from vibration sounds of a suction valve or ripple sounds of refrigerant gas.

11 Claims, 6 Drawing Sheets

U.S. PATENT DOCUMENTS

| | | | | |
|---|---|---|---|---|
| 6,533,064 | B1 * | 3/2003 | Kim et al. | 181/250 |
| 6,805,088 | B2 * | 10/2004 | Tachibana et al. | 123/184.47 |
| 2002/0017425 | A1 | 2/2002 | Yoon et al. | |
| 2003/0071382 | A1 * | 4/2003 | Neal | 264/40.5 |
| 2004/0052653 | A1 | 3/2004 | Kubota et al. | |
| 2004/0241011 | A1 * | 12/2004 | Yagi et al. | 417/312 |
| 2005/0100456 | A1 * | 5/2005 | Osaka et al. | 417/415 |

FOREIGN PATENT DOCUMENTS

| | | |
|---|---|---|
| EP | 1 413 754 | 4/2004 |
| JP | 56-077509 | 6/1981 |
| JP | 10-184542 | 7/1998 |

* cited by examiner

REFRIGERATING COMPRESSOR

TECHNICAL FIELD

The present invention relates to refrigerating compressors to be used for performing a refrigerating cycle in refrigerators and such.

BACKGROUND ART

A conventional refrigerating compressor includes a suction muffler open into a hermetic container for sucking refrigerant gas. The suction muffler has a resonating chamber, thereby reducing sounds at a specific frequency. An instance is disclosed in Japanese Patent Unexamined Publication No. H10-184542 (hereinafter referred to as "patent document 1"). The conventional refrigerating compressor is described hereinafter with reference to accompanying drawings.

FIG. 6 shows a partially cutaway perspective view illustrating an entire construction of the conventional refrigerating compressor disclosed in patent document 1. FIG. 7 shows a partially cutaway perspective view illustrating parts of a compressing element and a suction muffler to be used in the conventional refrigerating compressor.

In FIGS. 6 and 7, hermetic container 1 (hereinafter referred to simply as "container 1") pooling lubricant (not shown) accommodates compressing member 20 supported by elastic member 6 such as a spring. Compressing member 20 has motor element 2 and compressing element 3 disposed under and over frame 5 respectively. Frame 5 includes a bearing (not shown) for supporting a crank shaft (not shown) unitarily molded with crank pin 4.

Crank pin 4 (hereinafter referred to simply as "pin 4") is eccentrically fastened into the crank shaft press-fitted into a rotor (not shown) of motor element 2. Piston 7 is inserted in cylinder 8 and is able to reciprocate. Coupling means 9 couples piston 7 to pin 4.

Valve plate 10 (hereinafter referred to simply as "plate 10") having a suction port (not shown) seals an end face of an opening of cylinder 8. Opening of the suction valve allows the suction port to communicate with cylinder 8. Cylinder 8, a top plate of piston 7 and plate 10 form a compressing chamber (not shown).

Cylinder head 11 (hereinafter called simply as "head 11"), in which a high pressure chamber is formed, is rigidly placed opposite to cylinder 8 via plate 10 in between. Suction muffler 12 includes tail tube 13 and resonator 16. Tail tube 13 opens into container 1, and refrigerant gas is sucked through tail tube 13. Resonator 16 has resonating chamber 15 communicating with tail tube 13 and throttle hole 14. A first end of communicating tube 17 is coupled via head 11 to the suction port disposed on plate 10, and a second end thereof is coupled to suction muffler 12.

An operation of the refrigerating compressor discussed above is described hereinafter. Motor element 2 drives the crank shaft, so that pin 4 starts eccentric movement, which reciprocates piston 7 via coupling means 9 in cylinder 8. Then the steps of sucking refrigerant gas, compressing the gas, and discharging the gas are sequentially repeated in the compressing chamber.

In the sucking step by piston 7, the refrigerant gas filled in container 1 is sucked from an opening of tail tube 13. The gas sucked then travels to the suction port via a suction path formed of muffler 12, communicating tube 17 and head 11. The gas further pushes the suction valve, which closes the suction port, open and flows into cylinder 8. When the refrigerant gas flows into cylinder 8, the suction valve vibrates and the gas ripples, thereby producing noises. Sound in low frequency band (approx. 400 Hz-600 Hz) out of the noises can be deadened by resonator 16.

In the recent application, a refrigerating compressor having more excellent sound deadening characteristics is required.

SUMMARY OF INVENTION

A refrigerating compressor of the present invention has a compressing element, a hermetic container accommodating the compressing element therein. The compressing element includes a compressing chamber in which refrigerant gas is compressed, and a suction muffler which communicates with the compressing chamber and has a sound deadening space therein. The suction muffler has a tail tube which opens into the hermetic container at its first end and opens into the sound deadening space at its second end, and a resonating chamber formed attached to the tail tube and having a resonance frequency substantially agreeing with a specific resonance frequency of the container. This construction allows the resonating chamber to deaden the noises coming from vibrating sounds of the suction valve and ripple sounds of the refrigerant gas.

DETAILED DESCRIPTION OF PREFERRED EMBODIMENT

An exemplary embodiment of the present invention is demonstrated hereinafter with reference to the accompanying drawings. Not to mention, this embodiment does not limit the invention.

Figure 1:
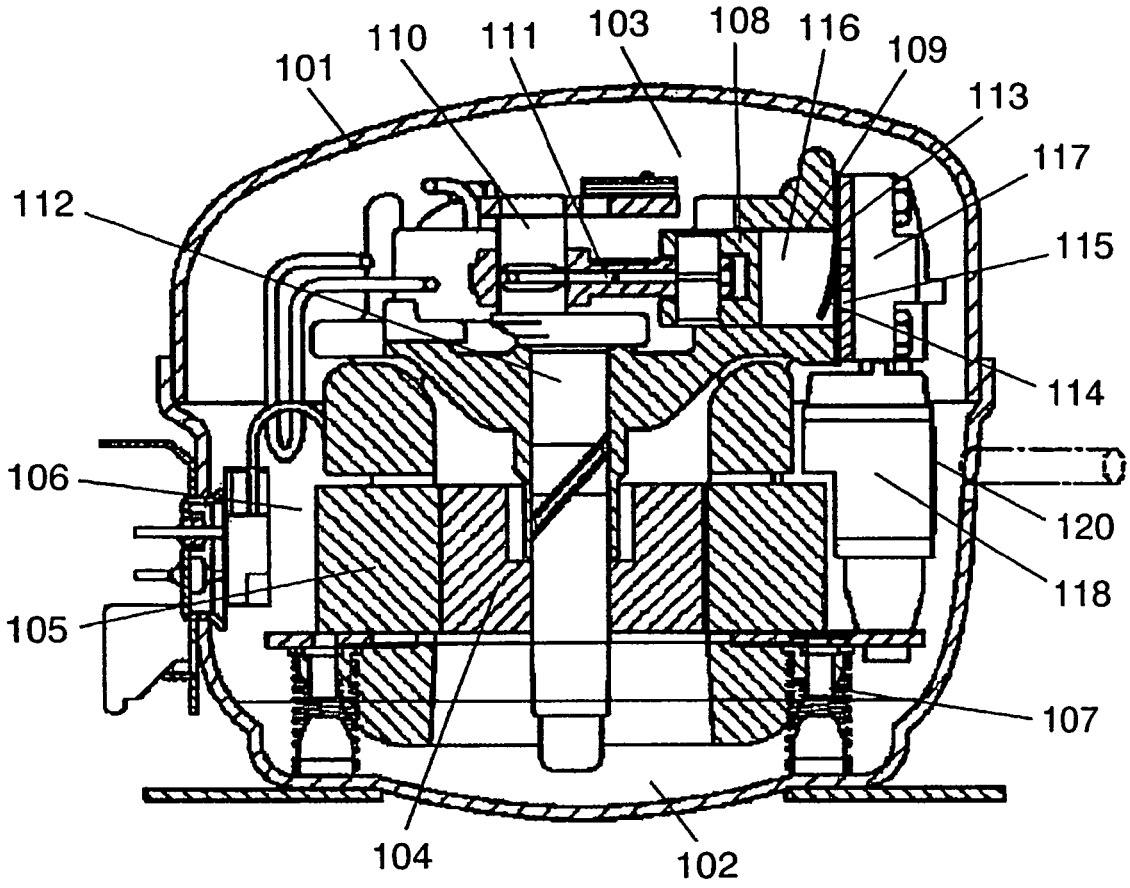
FIG. 1 shows a lateral sectional view of a refrigerating compressor in accordance with an exemplary embodiment of the present invention.
Figure 2:
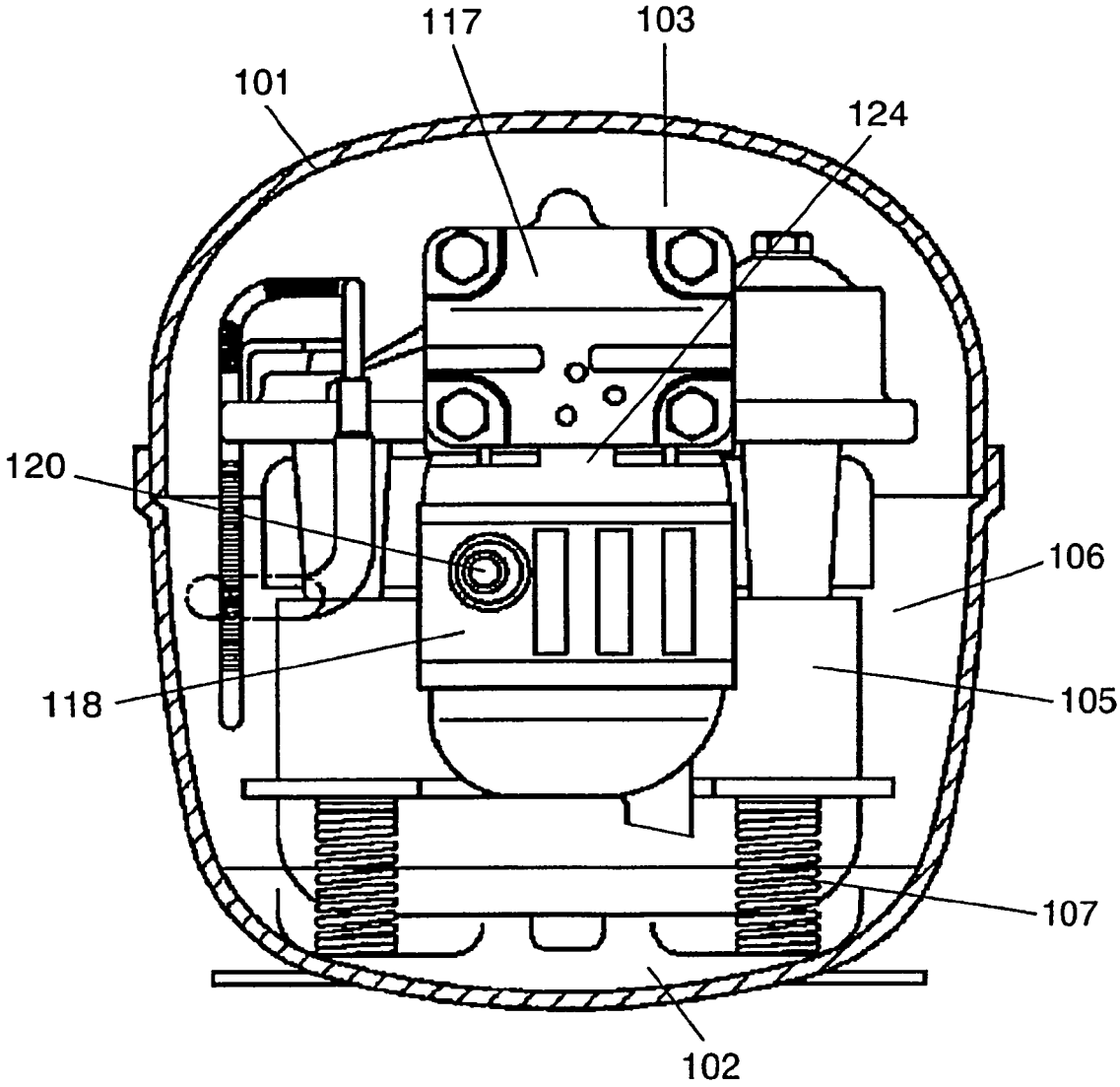
FIG. 2 shows a front sectional view of the refrigerating compressor shown in FIG. 1.
Figure 3:
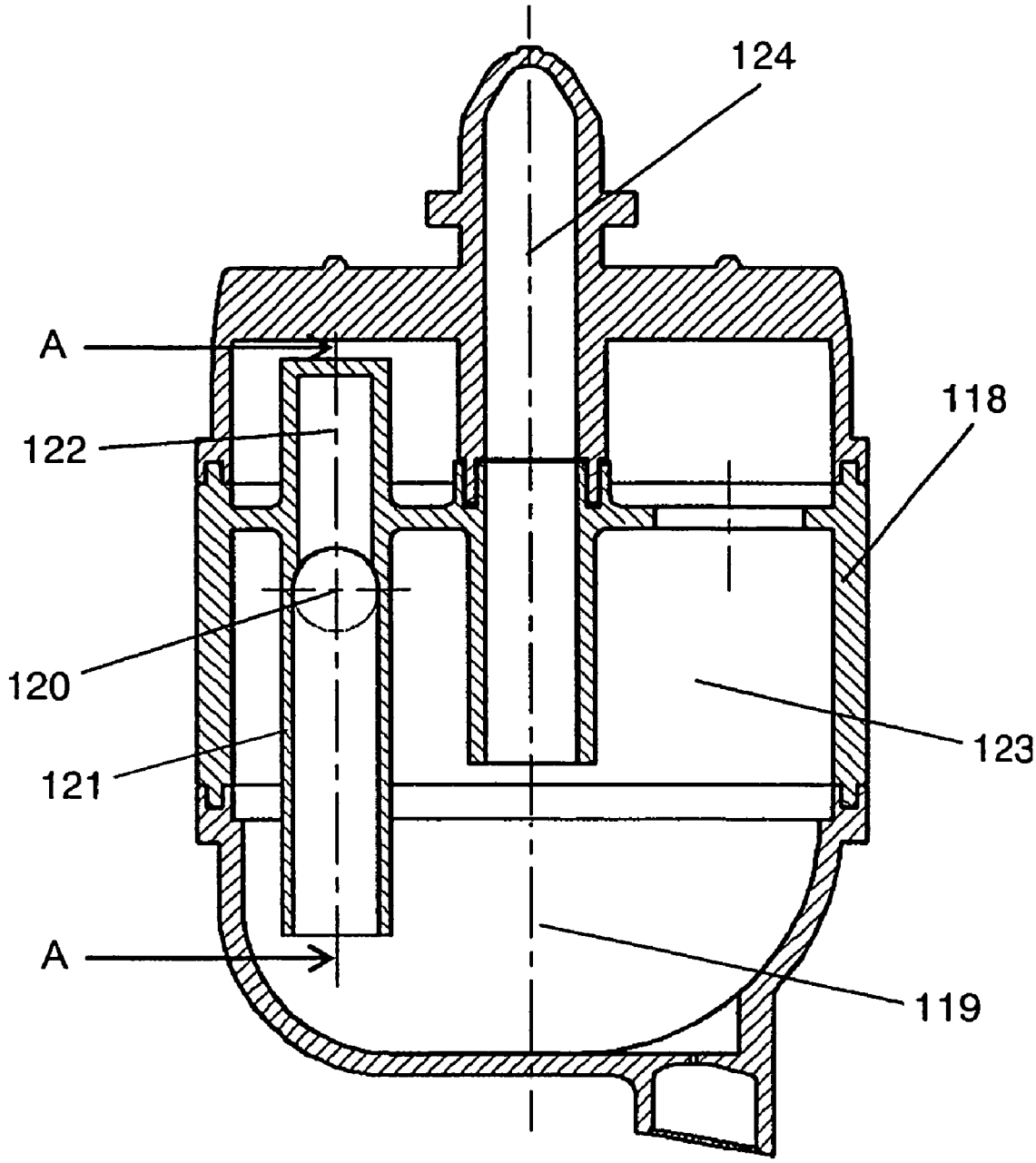
FIG. 3 shows a front sectional view of a suction muffler to be used in the refrigerating compressor shown in FIG. 1.
Figure 4:
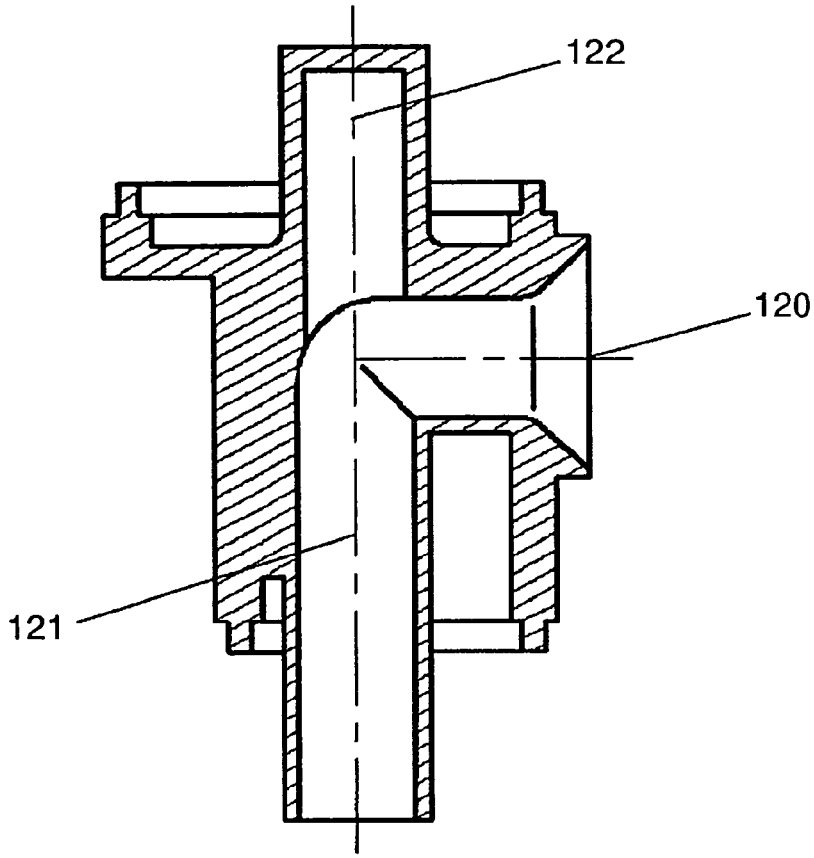
FIG. 4 shows a sectional view of the suction muffler taken along line A-A in FIG. 3.
Figure 5:
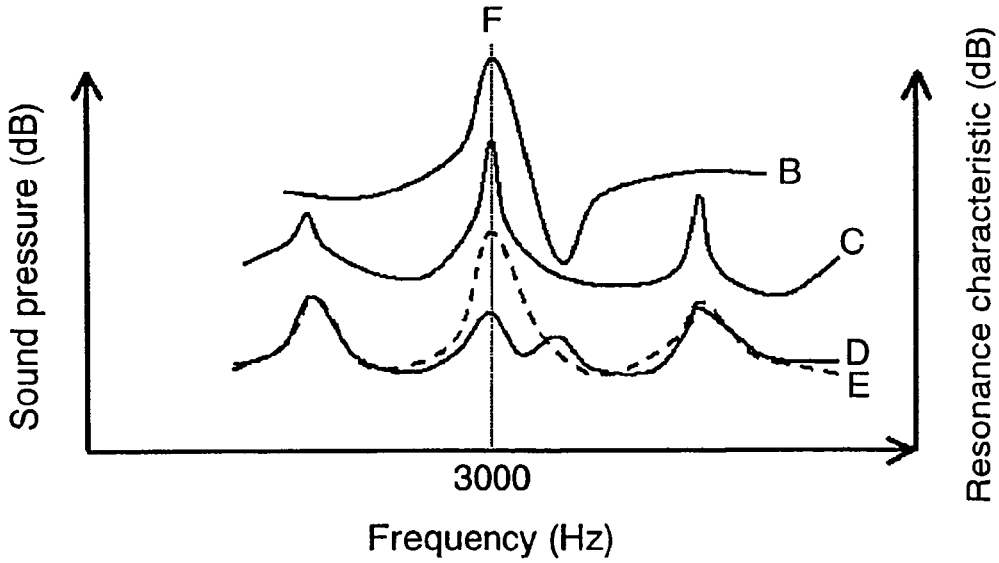
FIG. 5 shows sound deadening characteristics of the suction muffler shown in FIG. 4, resonance characteristics of a hermetic container, and a noise level of the compressor.
Figure 6:
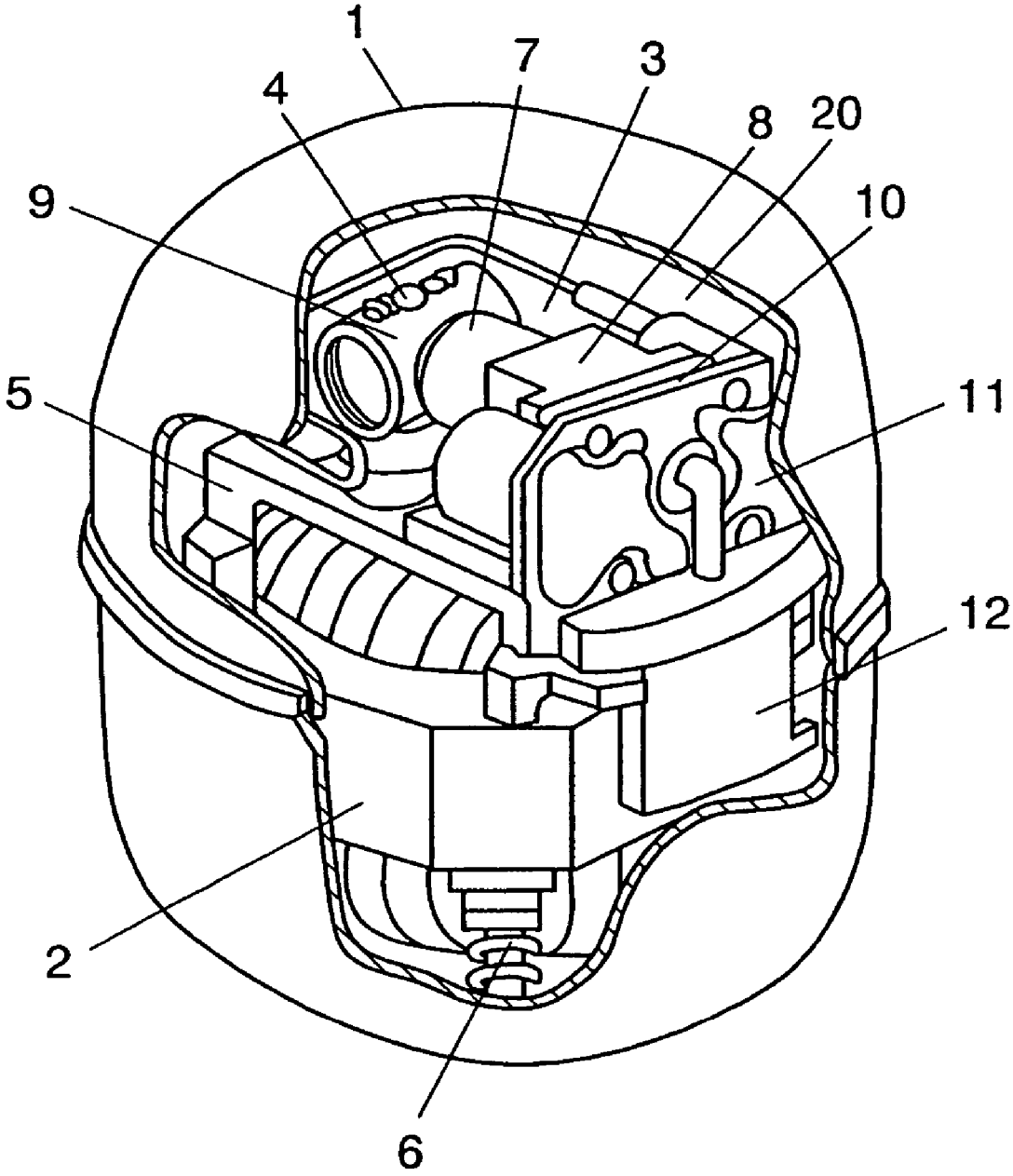
FIG. 6 shows a partially cutaway perspective view illustrating an entire construction of a conventional refrigerating compressor.
Figure 7:
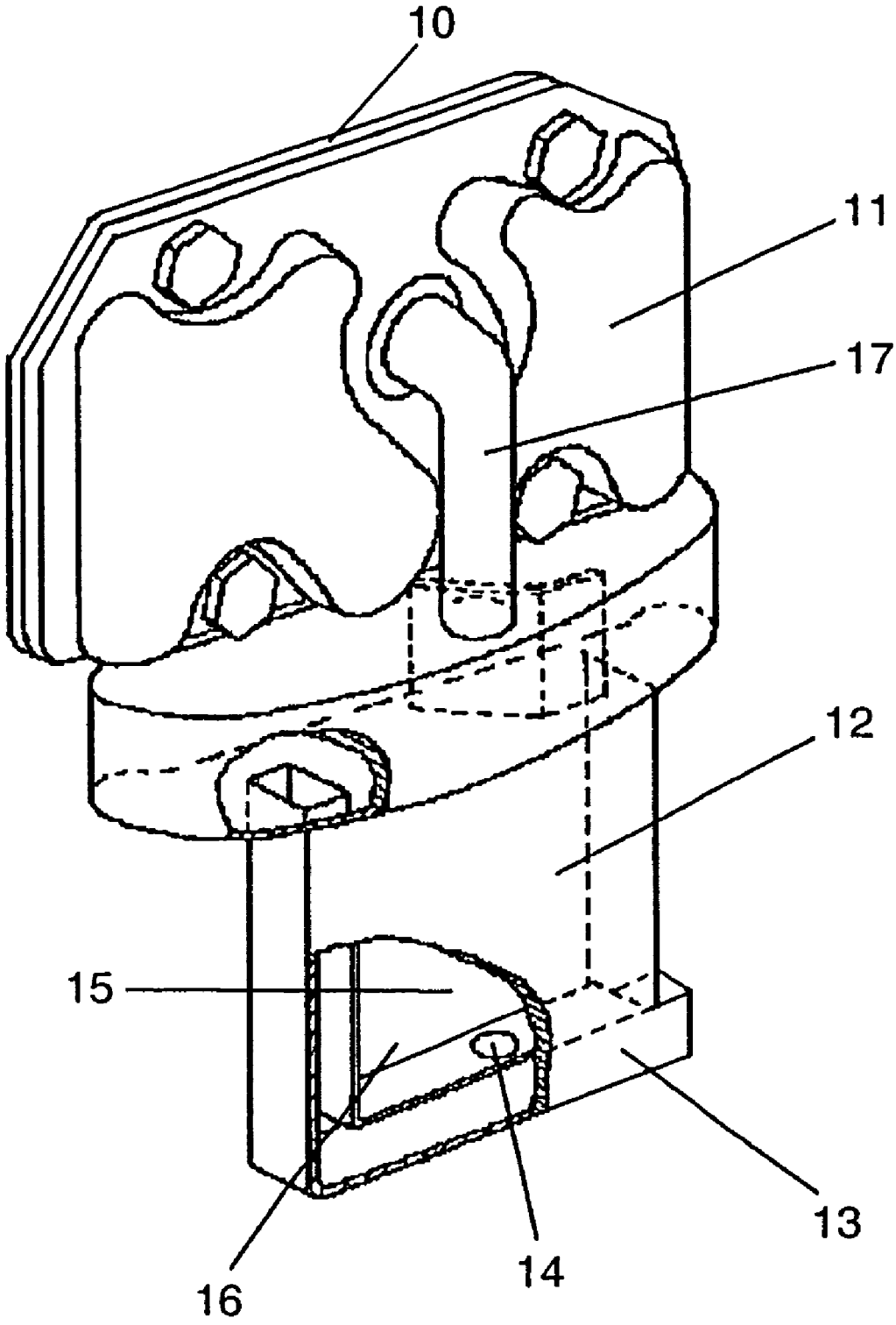
FIG. 7 shows a partially cutaway perspective view illustrating parts of a compressing element and a suction muffler to be used in the conventional refrigerating compressor.

FIG. 1 shows a lateral sectional view of a refrigerating compressor in accordance with the exemplary embodiment of the present invention. FIG. 2 shows a front sectional view of the refrigerating compressor shown in FIG. 1. FIG. 3 shows a front sectional view of a suction muffler to be used in the refrigerating compressor shown in FIG. 1. FIG. 4 shows a sectional view of the suction muffler taken along line A-A in FIG. 3. FIG. 5 shows sound deadening characteristics of the suction muffler shown in FIG. 4, resonance characteristics of a hermetic container, and a noise level of the compressor.

In FIG. 1 through FIG. 4, hermetic container 101 (hereinafter referred to simply as "container 101") pools lubricant 102, and is filled with refrigerant gas at its space. Container 101 accommodates a compressing member formed of compressing element 103 and motor element 106. The compressing member is supported by elastic member 107 such as a spring. Compressing element 103 sucks refrigerant gas filled in container 101 and compresses the gas. Motor element 106 has rotor 104, which drives compressing element 103, and stator 105.

Piston 108 is inserted into cylinder 109 and is able to reciprocate. Connecting rod 111 couples piston 108 to crank pin 110 (hereinafter referred to simply as "pin 110"). Pin 110 is eccentrically formed on crank shaft 112 (hereinafter referred to as "shaft 112") press-fitted into rotor 104.

Valve plate 113 (hereinafter referred to as "plate 113") seals an opening end of cylinder 109, and includes suction port 115 which communicates with cylinder 109 when suction valve 114 opens. Compressing chamber 116 is formed of cylinder 109, a top face of piston 108 and plate 113.

Cylinder head 117 (hereinafter referred to simply as "head 117") where a high pressure chamber is formed is rigidly placed opposite to cylinder 109 via plate 113 in between. Suction muffler 118 is made of resin, and includes sound deadening space 119 (hereinafter referred to simply as "space 119"), tail tube 121 (hereinafter referred to simply as "tube 121"), resonating chamber 122 (hereinafter referred to simply as "chamber 122"), and expansion chamber 123. Tube 121 opens into space 119 at its first end and opens into container 110 at its second end which works as suction inlet 120 sucking the refrigerant gas. Chamber 122 communicates with tube 121. Expansion chamber 123 is formed in space 119. Communicating tube 124 (hereinafter referred to simply as "tube 124") is coupled to suction port 115 at its first end via head 117, and coupled to muffler 118 at its second end. Muffler 118 thus communicates with compressing chamber 116 when suction valve 114 opens.

Chamber 122 is a side-branch type resonator that has no throttle portion at a communicating section with tube 121. A resonance frequency of chamber 122 is set such that it substantially agrees with a specific resonance frequency (e.g. approx. 3000 Hz) occurring at a lateral section having a small curvature of container 101. Tube 121 is formed to have a letter "L" shape. Chamber 122 is formed substantially on an extension line of one of axes of the letter "L" and disposed outside expansion chamber 123. Chamber 122 has an opening downwardly open to tube 121. Chamber 123 and tube 121 form an expansion type muffler.

An operation and a work of the refrigerating compressor discussed above are demonstrated hereinafter. Rotation of rotor 104 spins shaft 112, so that pin 110 moves eccentrically, which reciprocates piston 108 in cylinder 109 via connecting rod 111. In compressing chamber 116, the steps of sucking the refrigerant gas, compressing the gas, and discharging the gas are repeated in this order.

In the sucking step by piston 108, the refrigerant gas in container 101 is sucked from suction inlet 120 and travels to suction port 115 via a suction path formed of tube 121, expansion chamber 123, communicating tube 124 and head 117. The sucked refrigerant gas pushes suction valve 114, which closes suction port 115, opens and flows into compressing chamber 116.

When the refrigerant gas flows into cylinder 116, the suction valve 114 vibrates and the gas ripples, thereby producing noises. Some noises out of those noises produced can be deadened by expansion chamber 123 and chamber 122, and have a frequency substantially agreeing with specific frequencies (e.g. approx. 3000 Hz) occurring at lateral sections having small curvatures of container 101.

In general, frequency "F" (hereinafter referred to as resonance frequency "F") of the noises that can be deadened by a side-branch resonant-type muffler is determined by length "Lp" and inner diameter "D" of a resonating chamber of the muffler, and sound velocity "C" of the refrigerant gas in the muffler. Resonance frequency "F" is expressed by formula (1) as follows:

$$F = \frac{(2n-1)C}{4(L_p + 0.8D)} \quad (n = 1, 2, 3, \ldots) \tag{1}$$

An agreement of resonance frequency "F" of the resonant-type muffler with the specific resonance frequency of container 101 deadens the noises generated by container 101. Thus the present invention adjusts inner diameter "D" and length "Lp" of chamber 122 so that resonance frequency "F" can substantially agree with the specific frequency (e.g. approx. 3000 Hz).

In the resonant-type muffler, if refrigerant gas leaks from chamber 122, inner diameter "D" and length "Lp" of chamber 122 vary substantially, so that resonating frequency "F" expressed by formula (1) varies. However, because muffler 118 of the present invention is made of resin and chamber 122 is monolithically molded, no refrigerant gas leaks from chamber 122, so that resonance frequency "F" of chamber 122 does not vary.

On top of that, tube 121 of the present invention is shaped like the letter "L", and chamber 122 is formed on an extension line of one of the axes of tube 121. This structure allows tube 121 and chamber 122 to be monolithically molded by one molding die, and a molded article can be released from the molding die with ease. The monolithically molding prevents the refrigerant gas from leaking at the communicating section between tube 121 and chamber 122. This structure allows resonance frequency "F" of chamber 122 to stay unchanged and the number of components not to increase.

On the other hand, sound deadened amount "A" is determined by sectional area "S", its length "L" of an expansion chamber and sectional area $S_0$ and its length $L_0$ of a tail tube, so that amount "A" can be expressed approximately by the following formula (2):

$$A = 20\log\left|\frac{S}{S_0}\sin kL \times \sin kL_0\right| \quad (k\text{:constant}) \tag{2}$$

The present invention forms resonating chamber 122 outside expansion chamber 123, so that vibrations in chamber 122 do not affect expansion chamber 123. As a result, the sound deadening characteristics of the suction muffler 118 are not lowered by expansion chamber 123.

If lubricant 102 is sucked into tube 121 together with the refrigerant gas and pooled in chamber 122, length $L_0$ of chamber 122 varies. In this case, resonance frequency "F" expressed by formula (1) varies; however, in the present invention, an opening of chamber 122 to tube 121 faces downward, so that lubricant 102 does not stay in chamber 122, and length $L_0$ of chamber 122 thus does not change. As a result, resonance frequency "F" of resonating chamber 122 does not change at all.

The above discussion concludes that muffler 118, during an operation of the refrigerating compressor, steadily maintains the sound deadening characteristics of resonance frequency "F" which substantially agrees with the specific resonance frequency (e.g. approx. 3000 Hz) of container 101.

FIG. 5 shows the sound deadening characteristics of muffler 118 having the structure discussed above. In FIG. 5, curve B shows a level of sound deadening characteristics of muffler 118, curve C shows a level of resonance characteristics of container 101, and curve D shows a noise level of the refrigerating compressor lowered by the sound deadening function of muffler 118. Curve E shows a noise level of a refrigerating compressor with a conventional suction muffler.

As FIG. 5 tells, the noise level at frequency "F" (approx. 3000 Hz) around the specific resonance frequency of container 101 is lowered by muffler 118. The noises generated by resonance of container 101 can be thus steadily lowered. Meanwhile, a side-branch type resonator is used in this embodiment; however, a helmholtz-type resonator or a perforated tube-type resonator can be provided to tail tube 121 with sound deadening characteristics similar to what is discussed above.

INDUSTRIAL APPLICABILITY

The refrigerating compressor of the present invention lowers the noises generated by resonance of its hermetic container, so that the compressor is fit for refrigerating compressors to be used in air-conditioners or refrigerators.

The invention claimed is:

1. A refrigerating compressor comprising:
a compressing element; and
a hermetic container that accommodates the compressing element,
wherein the compressing element includes
a compressing chamber where refrigerant gas is to be compressed, and
a suction muffler that communicates with the compressing chamber, the suction muffler having a sound deadening space formed therein,
wherein the suction muffler includes
a tail tube having a first end which opens into the hermetic container and a second end which opens directly into the sound deadening space, a diameter of the sound deadening space being larger than a diameter of the second end of the tail tube, the tail tube being arranged such that the second end of the tail tube protrudes into and is surrounded by the sound deadening space,
an expansion chamber arranged within the sound deadening space, and
a resonating chamber formed outside of the expansion chamber, the resonating chamber having a resonance frequency agreeing substantially with a specific resonance frequency of the hermetic container,
wherein the resonating chamber has an opening arranged to face the sound deadening space in a direction in which refrigerant gas is to flow toward the second end of the tail tube, the resonating chamber and the tail tube being in communication with each other at a communicating section, the resonating chamber extending from the opening of the resonating chamber and away from the sound deadening space,
wherein the communicating section does not include a throttle portion, wherein the resonating chamber is arranged entirely within the suction muffler, and wherein the tail tube and the resonating chamber are monolithically molded.

2. The refrigerating compressor of claim 1,
wherein the suction muffler is made of resin.

3. The refrigerating compressor of claim 2,
wherein the tail tube is shaped like a letter "L", and the resonating chamber is formed on an extension line of at least one axis of the tail tube.

4. The refrigerating compressor of claim 1, wherein the opening of the resonating chamber is arranged at a first end of the resonating chamber, and wherein a second end of the resonating chamber is closed.

5. The refrigerating compressor of claim 1, wherein the second end of the tail tube protrudes into the sound deadening space such that an entire circumference of the second end of the tail tube is surrounded by the sound deadening space.

6. The refrigerating compressor of claim 1, wherein an interior of the resonating chamber is completely unobstructed.

7. A refrigerating compressor comprising:
a compressing element; and
a hermetic container that accommodates the compressing element,
wherein the compressing element includes
a compressing chamber where refrigerant gas is to be compressed, and
a suction muffler that communicates with the compressing chamber, the suction muffler having a sound deadening space formed therein,
wherein the suction muffler includes
a tail tube having a first end which opens into the hermetic container and a second end which opens directly into the sound deadening space, a diameter of the sound deadening space being larger than a diameter of the second end of the tail tube, the tail tube being arranged such that the second end of the tail tube protrudes into and is surrounded by the sound deadening space,
an expansion chamber arranged within the sound deadening space, and
a resonating chamber formed outside of the expansion chamber and attached to the tail tube, the resonating chamber having a resonance frequency agreeing substantially with a specific resonance frequency of the hermetic container,
wherein the tail tube is arranged to suck the refrigerant gas into the resonating chamber along an L-shaped path, and the resonating chamber is formed on an extension line of an axis of the tail tube such that the resonating chamber has an opening arranged to face the sound deadening space in a direction in which refrigerant gas is to flow toward the second end of the tail tube, and such that the resonating chamber extends from the opening of the resonating chamber and away from the sound deadening space,
wherein the resonating chamber and the tail tube are in communication with each other at a communicating section which does not include a throttle portion, and wherein the resonating chamber is arranged entirely within the suction muffler.

8. The refrigerating compressor of claim 7,
wherein the suction muffler is made of resin, and wherein the tail tube and the resonating chamber are monolithically molded.

9. The refrigerating compressor of claim 7, wherein the opening of the resonating chamber is arranged at a first end of the resonating chamber, and wherein a second end of the resonating chamber is closed.

10. The refrigerating compressor of claim 7, wherein the second end of the tail tube protrudes into the sound deadening space such that an entire circumference of the second end of the tail tube is surrounded by the sound deadening space.

11. The refrigerating compressor of claim 7, wherein an interior of the resonating chamber is completely unobstructed.

* * * * *